US005880763A

United States Patent [19]

Tanaka et al.

[11] Patent Number: 5,880,763

[45] Date of Patent: Mar. 9, 1999

[54] INK JET RECORDING HEAD WITH HEAD FRAME AND PIEZOELECTRIC VIBRATION ELEMENTS HAVING CONFIGURATION FOR SUPPRESSING STRESS IN FLOW PATH UNIT

[75] Inventors: Yuji Tanaka; Shuji Yonekubo; Koji Morikoshi, all of Nagano, Japan

[73] Assignee: Seiko Epson Corporation, Tokyo, Japan

[21] Appl. No.: 413,473

[22] Filed: Mar. 28, 1995

[30] Foreign Application Priority Data

| | | | |
|---|---|---|---|
| Mar. 28, 1994 | [JP] | Japan | 6-057557 |
| Apr. 19, 1994 | [JP] | Japan | 6-080673 |
| Mar. 17, 1995 | [JP] | Japan | 7-086252 |

[51] Int. Cl.[6] ..... B41J 2/045

[52] U.S. Cl. ..... 347/70; 347/71

[58] Field of Search ..... 347/70, 68, 71, 347/72, 47

[56] References Cited

U.S. PATENT DOCUMENTS

| | | | |
|---|---|---|---|
| 4,801,947 | 1/1989 | Lichtenberger et al. | 347/47 |
| 5,424,769 | 6/1995 | Sakai et al. | 347/70 |
| 5,439,728 | 8/1995 | Morozumi et al. | 347/68 X |
| 5,453,769 | 9/1995 | Schantz et al. | 347/47 X |
| 5,539,982 | 7/1996 | Hosono et al. | 347/70 X |
| 5,548,894 | 8/1996 | Muto | 347/47 X |
| 5,710,584 | 1/1998 | Suzuki et al. | 347/70 |
| 5,764,257 | 6/1998 | Miyazawa et al. | 347/71 |

FOREIGN PATENT DOCUMENTS

| | | | |
|---|---|---|---|
| 0443628 | 8/1991 | European Pat. Off. | B41J 2/045 |
| 519278 | 12/1992 | European Pat. Off. | 347/70 |
| A0516188 | 12/1992 | European Pat. Off. . | |
| 550030 | 7/1993 | European Pat. Off. . | |
| 0 630 748 A2 | 12/1994 | European Pat. Off. . | |
| 5169657 | 7/1993 | Japan | 347/70 |

OTHER PUBLICATIONS

Patent Abstracts of Japan—vol. 018 No. 258 (M–1606), 17 May 1994—JP–A–06 040034 (Seiko Epson Corp). 15 Feb. 1994.

Patent Abstracts of Japan—vol. 018, No. 304 (M–1619), 10 Jun. 1994—JP–A–06 064163 (Seiko Epson Corp), 8 Mar. 1994.

*Primary Examiner*—Benjamin R. Fuller
*Assistant Examiner*—C. Dickens
*Attorney, Agent, or Firm*—Sughrue, Mion, Zinn, Macpeak & Seas, PLLC

[57] ABSTRACT

A bonding width L between a head frame 5 and a flow path unit 12 in a direction orthogonal to an array of pressure producing chambers 7 is set to 0.5b≦L≦5a if it is assumed that a distance from the bonding end to the piezoelectric vibration element 2 closest to the head frame 5 is a and that the bonding ends of the head frame 5 interposing the piezoelectric vibration element 2 is b. Cracking of a spacer 6 or separation of the spacer 6 from a resilient plate 4 is prevented by ensuring a rigidity of the head frame 5 necessary for suppressing deformation of the flow path unit 12 and by causing the head frame 5 to absorb internal stresses of the flow path unit 12 caused by ambient temperature change.

8 Claims, 9 Drawing Sheets

INK JET RECORDING HEAD WITH HEAD FRAME AND PIEZOELECTRIC VIBRATION ELEMENTS HAVING CONFIGURATION FOR SUPPRESSING STRESS IN FLOW PATH UNIT

BACKGROUND OF THE INVENTION

1. Field of the Invention

The invention relates to an ink jet recording head for use in recording apparatuses such as printers for forming an ink image on a recording medium such as recording paper by splashing ink droplets.

2. Related Art

An ink jet recording head, which is designed to deform a resilient plate constituting one surface of a pressure producing chamber in a piezoelectric vibration element displacement direction so that an ink droplet is expelled from a nozzle communicating with the pressure producing chamber, can have such possibility of being driven at low voltage, of having high density, etc.

However, to expel an ink droplet, it is necessary to cause a piezoelectric vibration element to change the capacity of a pressure producing chamber. Therefore, a flow path unit constituting these pressure producing chambers must have as small a rigidity as possible. As a result, upon receiving a displacement of a piezoelectric vibration element at the time an ink droplet is expelled, the flow path unit is deformed as a whole unnecessarily; particularly, large stresses are applied to regions where the flow path unit is fixed to a head frame that is a member for bonding the flow path unit to the piezoelectric vibration element.

Thus, if the flow path unit is formed by bonding a nozzle plate, a spacer, and the resilient plate to one another, the bonded surface is separated or cracked, which is a problem.

Further, if the piezoelectric vibration element is bonded to a vibration plate at a high temperature, there is a difference between the temperature at the time of manufacturing the recording head and the temperature at the time of using the recording head, which in turn causes the flow path unit to be biased to the piezoelectric vibration element at all times due to a thermal expansion difference between the head frame and the piezoelectric vibration element. As a result, not only the ink expelling performance becomes inconsistent, but also the bonded surface is likely to be separated.

Further, the deformation of the flow path unit causes inconsistencies in the direction of the nozzle opening at the time of expelling an ink droplet on both end portions of the nozzle opening array and in the middle thereof, or inconsistencies in the force applied to the pressure producing chamber, which in turn causes fluctuations in the ink droplet falling positions on a recording medium and the amount of ink expelled, which is another problem.

To overcome these problems, an ink jet recording head is proposed in, e.g., Unexamined Japanese Patent Publication No. Hei. 4-361045. This ink jet recording head is characterized as not only forming dummy pressure producing chambers that have nothing to do with printing on both end portions of the nozzle opening array, but also arranging piezoelectric vibration elements therefor, so that printing is effected only with pressure producing chambers that are toward the middle with respect to these dummy pressure producing chambers.

According to this example, the amounts of deformation of a region relevant to printing can be made uniform to prevent impairment of printing quality. However, the dummy pressure producing chambers and the piezoelectric vibration elements therefor must be arranged, which in turn makes the size of the recording head as a whole and reduces yield as much as the number of parts is increased.

SUMMARY OF THE INVENTION

The invention has been made in view of the aforementioned problems. Accordingly, the object of the invention is to provide an ink jet recording head which can maintain printing quality with respect to not only stresses received at the time the piezoelectric vibration elements are driven but also ambient temperature changes without complicating the structure thereof, and which can maintain reliability with respect to large ambient temperature changes.

To achieve the above object, the invention is applied to an ink jet recording head comprising: a flow path unit being formed of a spacer, a nozzle plate, and a resilient plate, the spacer having a plurality of pressure producing chambers on a single plane in the form of an array, the nozzle plate having nozzles communicating with the pressure producing chambers and being laminated on one surface of the spacer, the resilient plate being laminated on the other surface of the spacer; a piezoelectric vibration element for selectively changing a capacity of the pressure producing chamber while abutted against the resilient plate; and a head frame for fixing the piezoelectric vibration elements to the flow path unit. In such ink jet recording head, a boding width L of the head frame with respect to the flow path unit in a direction orthogonal to the array of the pressure producing chambers is set to $$0.5b \leqq L \leqq 5a$$

if it is assumed that a distance from the bonding end to an end of a piezoelectric vibration element closest to the head frame is a and that a gap between the bonding ends of the head frame interposing the piezoelectric vibration element is b.

The head frame is given such a rigidity for suppressing the deformation of the flow path unit as necessary to maintain printing quality as well as the function of absorbing internal stresses of the flow path unit caused by ambient temperature change.

BRIEF DESCRIPTION OF THE DRAWINGS

FIG. 3(*b*) is a sectional view taken along a line B—B of FIG. 1;

DETAILED DESCRIPTION OF THE PREFERRED EMBODIMENTS

Ink jet recording heads, which are embodiments of the invention will now be described with reference to the drawings.

Figure 1:
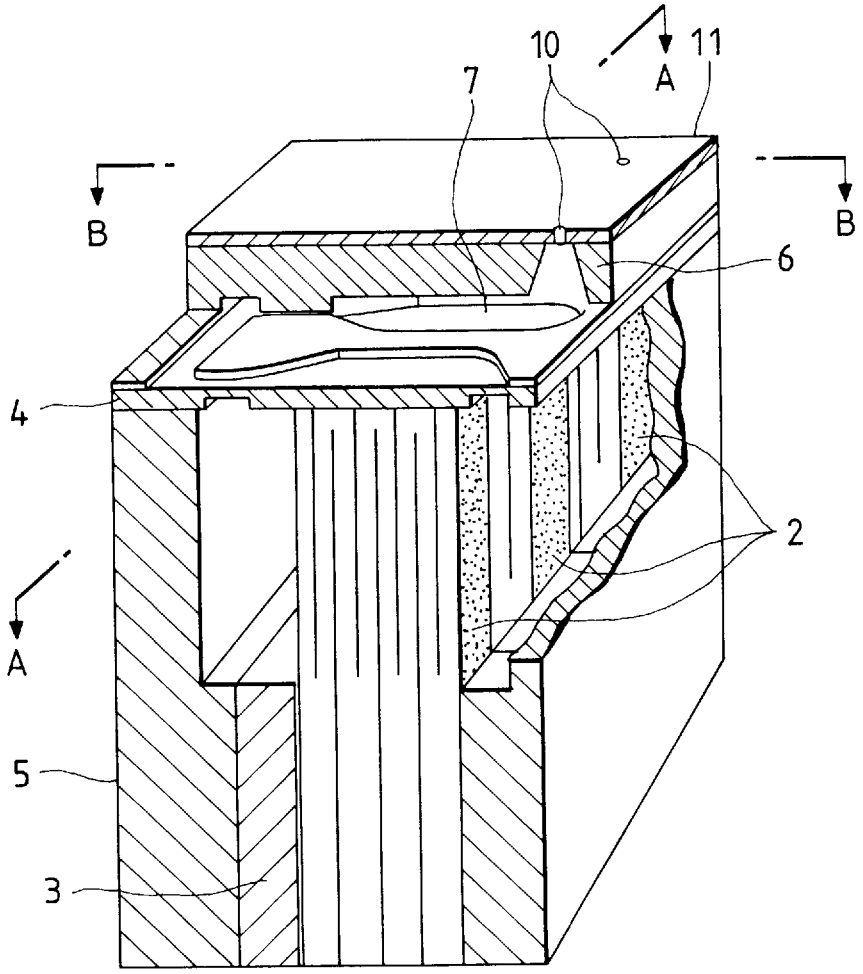
FIG. 1 is a sectional view showing an embodiment of the invention.
Figure 2:
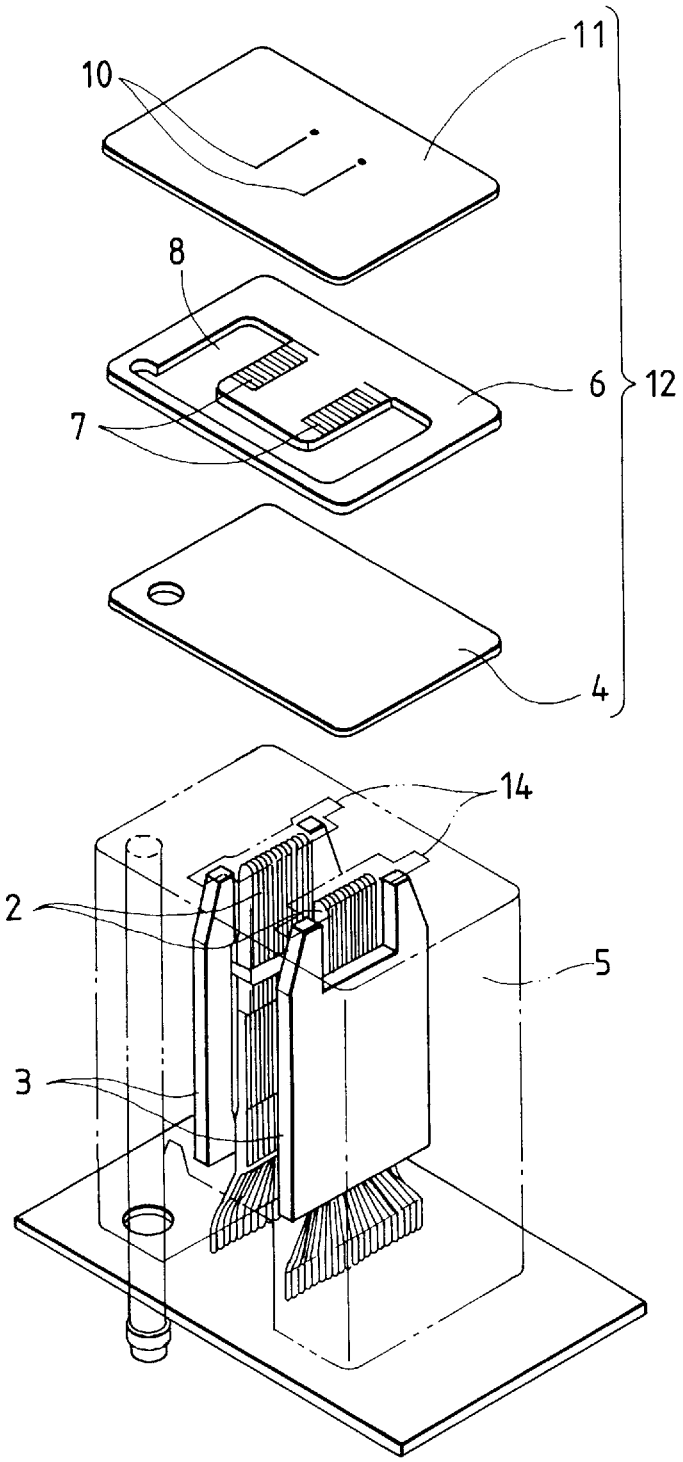
FIG. 2 is an exploded perspective view showing the embodiment of the invention.

FIGS. 1 and 2 show an ink jet recording head, which is an embodiment of the invention. In FIGS. 1 and 2, reference numerals 2, 2, . . . denote piezoelectric vibration elements, each expanding and contracting in a longitudinal direction (in vertical directions as viewed in FIGS. 1 and 2). It is the upper half of the piezoelectric vibration element that functions as an active region, i.e., that expands and contracts. The lower half serves as an inactive region. The active region is fixed to fixing plates 3 that are made of a highly rigid material, e.g., steel or ceramic. The thus constructed piezoelectric vibration elements are grouped into a vibration element unit.

The fixing plates 3 are accommodated in a piezoelectric vibration element accommodating chamber 14 of a head frame 5 with the front end of each piezoelectric vibration element 2 abutted against an islandlike projection 4*a* located between thin portions 4*b* of a resilient plate 4 that will be described later, and are fixed to the head frame 5 with an epoxy resin adhesive.

Reference numeral 6 denotes a spacer forming pressure producing chambers 7, a common ink chamber 8, and ink supply inlets 9. The spacer 6 has groove portions and through holes formed by removing unnecessary portions while subjecting a material such as a resin composition that hardens by irradiation of an active energy beam, glass, or silicon to etching using a predetermined mask pattern or the like, or desired groove portions and through holes are formed by injection molding using resin or the like.

On one surface of the spacer 6 is the resilient plate 4, and on the other surface thereof is a nozzle plate 11 bonded so as to be watertight. The nozzle plate 11 has nozzle openings 10, each having a diameter of from 30 to 70 $\mu$m. These three members constitute a flow path unit 12.

The flow path unit 12 is such that a resilient plate 4 side thereof is fixed to an opening end surface of the head frame 5 by an adhesive so that displacements of each piezoelectric vibration element 2', i.e., expansion and contraction thereof can be received.

Figure 3A:
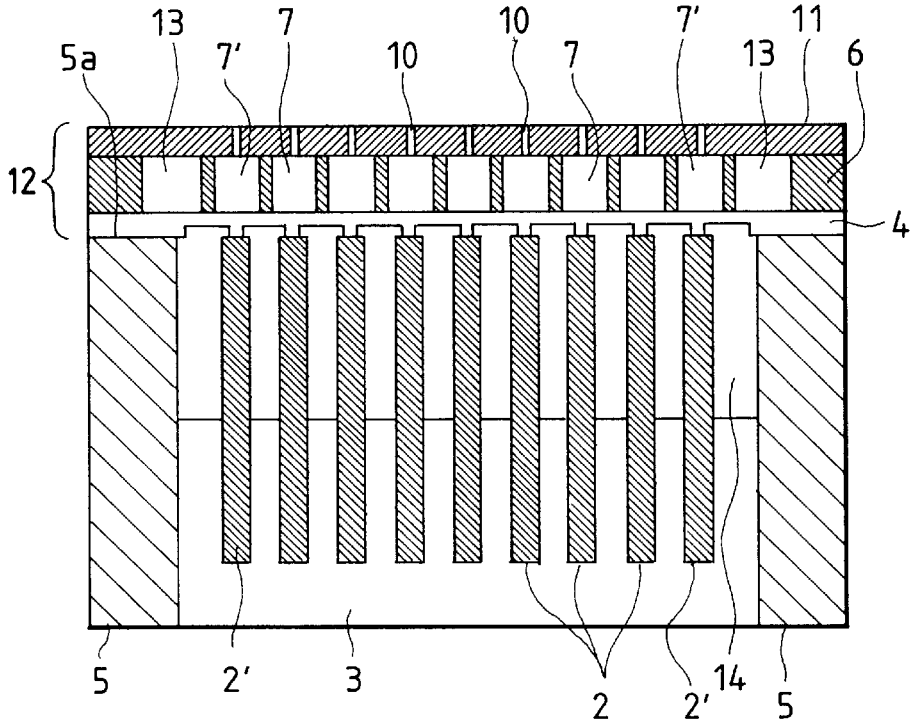
FIG. 3(*a*) is a sectional view taken along a line A—A of FIG. 1.
Figure 3B:
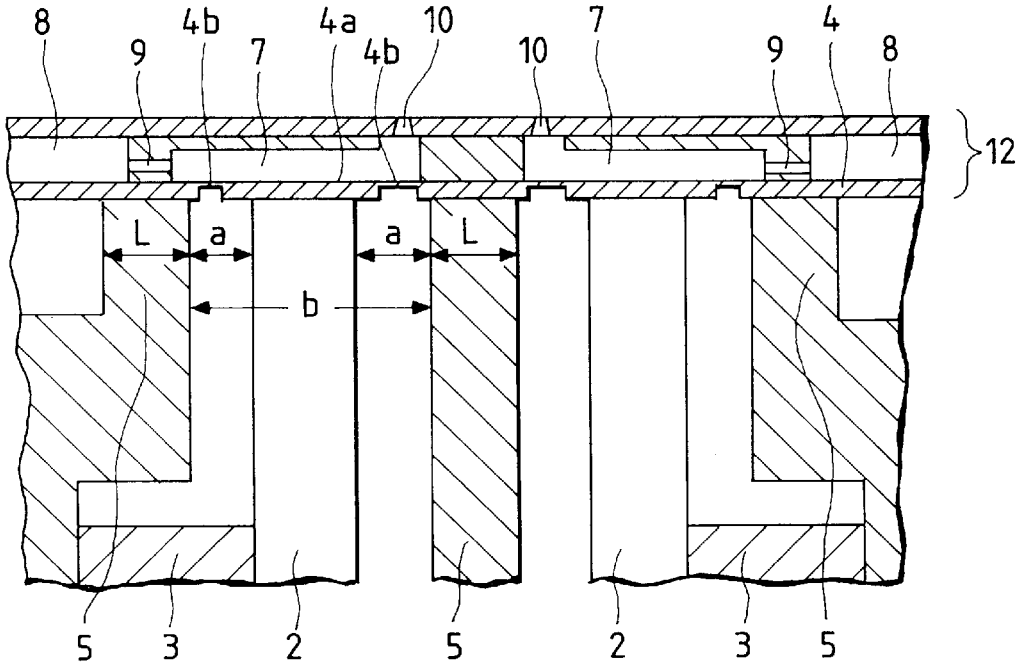
Figure 4:
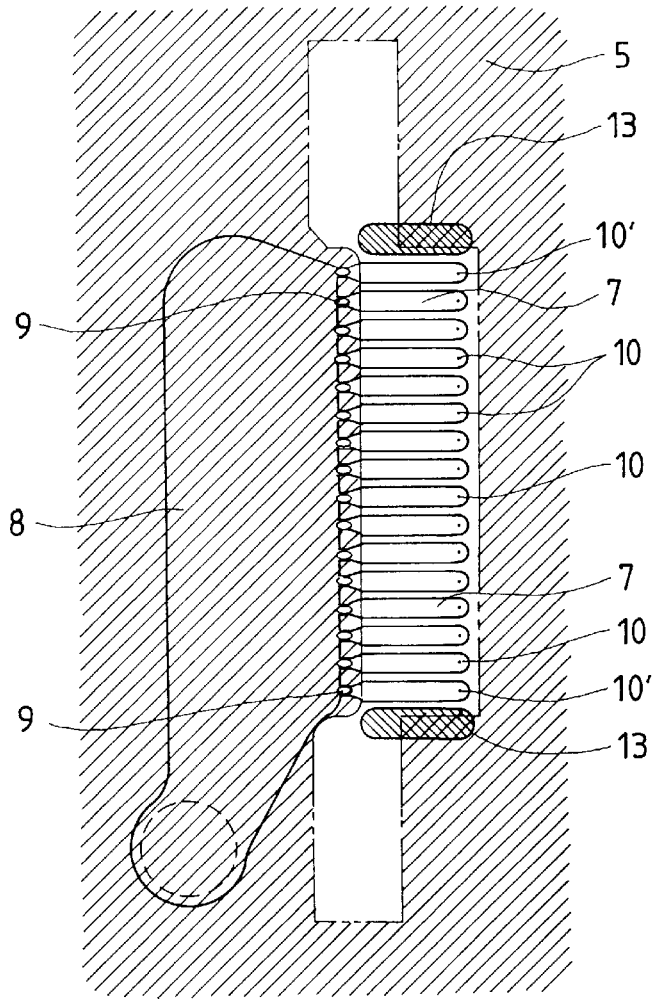
FIG. 4 is a diagram showing how a flow path unit is connected to a head frame.

FIGS. 3(*a*) and (*b*) show sectional structures taken along a line A—A and a line B—B in FIG. 1, respectively.

The structure of the nozzle openings in the direction of arrangement will be described first in more detail with reference to FIG. 3(*a*).

In FIG. 3(*a*), reference numerals 13, 13 denote hollows. Each hollow is located so that a part thereof confronts each of both ends of the pressure producing chambers 7, 7, i.e., the head frame 5 serving as the support point of the flow path unit 12 and a part thereof extends toward the piezoelectric vibration element accommodating chamber 14.

The hollows 13, 13 are formed by arranging through holes similar to the pressure producing chambers 7, 7, . . . in the spacer 6. The hollows 13, 13 are designed to reduce the rigidity of the fixed portions in the vicinity of the head frame 5, i.e., the rigidity of the flow path unit 12 in the vicinity of the endmost pressure producing chambers 7', 7' to the rigidity thereof in the middle portion.

The hollows 13, 13 are also available as dummy ink flow paths to help eliminate bubbles at the time of charging ink by causing the ink supply inlets or nozzle openings communicating with the common ink chamber 8 to communicate therewith in a manner similar to the pressure producing chambers 7, 7' if necessary.

Further, the width of the hollow 13 may desirably be set to ½ to 3 times the thickness of the spacer 6 for the following reasons. Too large a width, which decreases the fixing rigidity between the flow path unit 12 and the head frame 5, prevents reliable fixing therebetween, whereas too small a width, which excessively increases the rigidity close to the fixed regions, prevents uniform deformation of the flow path unit 12 at the time of expelling the ink.

On the other hand, in a direction orthogonal to the direction in which the nozzle openings 10, 10, 10 are arranged, i.e., in the longitudinal direction of the pressure producing chambers 7, the piezoelectric vibration elements 2 are arranged at predetermined distances from the head frame 5 with spaces formed by the piezoelectric vibration element accommodating chamber 14 interposed therebetween as shown in FIG. 3(*b*).

That is, the width L along which the head frame 5 is bonded to the flow path unit 12 is selected as $$0.5b \leqq L \leqq 5a$$

where a is the distance between the confronting surface of the piezoelectric vibration element 2 and that of the head frame 5, i.e., the distance from the bonding end of the flow path unit 12 to the piezoelectric vibration element 2 closest to the head frame 5; and b is such a width of the piezoelectric vibration element accommodating chamber 14 as to interpose the piezoelectric vibration element 2, i.e., the distance between the bonding ends of the head frame 5 interposing the piezoelectric vibration element 2.

The reasons why $0.5b \leqq L \leqq 5a$ is selected as the bonding region of the flow path unit 12 will be described next.

The piezoelectric vibration elements 2, 2, 2 are bonded to the flow path unit 12 with an epoxy resin adhesive that allows relatively high adhesive strength to be obtained. To shorten the bonding time, these members are usually heated to 40° to 60° C.

Figure 5:
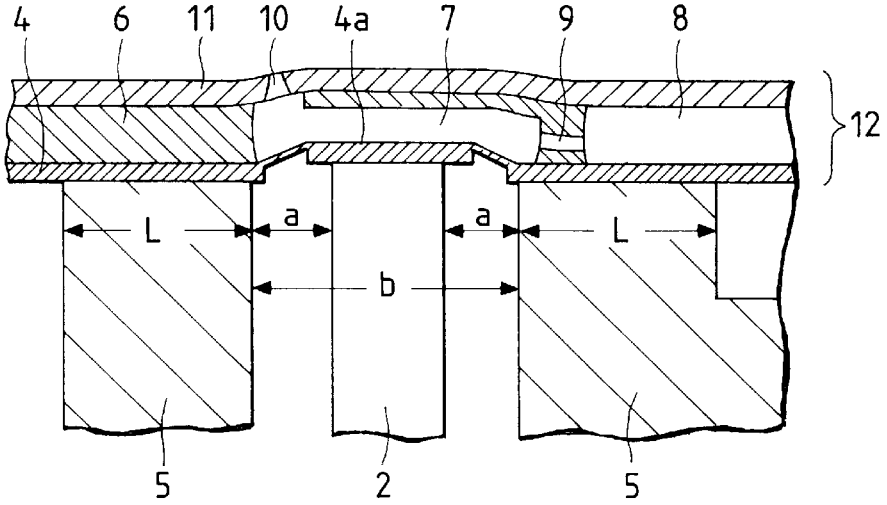
FIG. 5 is a sectional view showing how the flow path unit is deformed at the time of expelling an ink droplet in the invention.

Thus, if the completely assembled recording head is exposed to a temperature of −20° C., the head frame 5 is contracted as shown in FIG. 5 to cause the piezoelectric vibration element 2 to push the islandlike projection 4*a* of the resilient plate 4 up because of a difference in material between the head frame 5 and the piezoelectric vibration element 2. That is, the linear expansion coefficient of the head frame 5 is $2\times10^{5}$ (1/°C.), whereas the linear expansion coefficient of the piezoelectric vibration element 2 is $6\times10^{-6}$ (1/°C.), a difference of more than one order of magnitude.

Since the bonding width L is set to such a range as described above in the invention, the rigidity of the flow path unit 12 acts effectively on the head frame 5. That is, the rigidity of the flow path unit 12 pulls the bonding region of the head frame 5 toward the flow path unit 12, so that a part of a difference in the amount of deformation attributable to a difference in the thermal expansion coefficient between the head frame 5 and the piezoelectric vibration element 2 can be absorbed by the expansion of the head frame 5.

That is, since the sectional area of the bonding surface of the head frame 5 is small, the head frame 5 in this region is easy to expand, which in turn effectively prevents distortion of the flow path unit 12, the distortion being such as to cause separation in the bonding surface between the spacer 6 and the resilient plate 4 constituting the flow path unit 12.

In contrast thereto, a recording head having the bonding width L between the head frame and the flow path unit set to a value larger than 5*a* gives too small an expansion to the head frame 5 to absorb the stress of the flow path unit 12. As a result, the difference in the amount of deformation due to the difference in thermal expansion coefficient between the head frame 5 and the piezoelectric vibration element 2 is directly transformed into a distortion of the flow path unit 12, and the distortion acts as such a force for separating the resilient plate 4 from the spacer 6, both constituting the flow path unit 12, as shown in FIG. 6(*a*), thereby causing a separation 40 in a portion where the spacer 6 is bonded to the resilient plate 4, the portion being close to the ink supply inlet 9 whose bonding area is particularly small within the flow path unit 12.

Figure 6A:
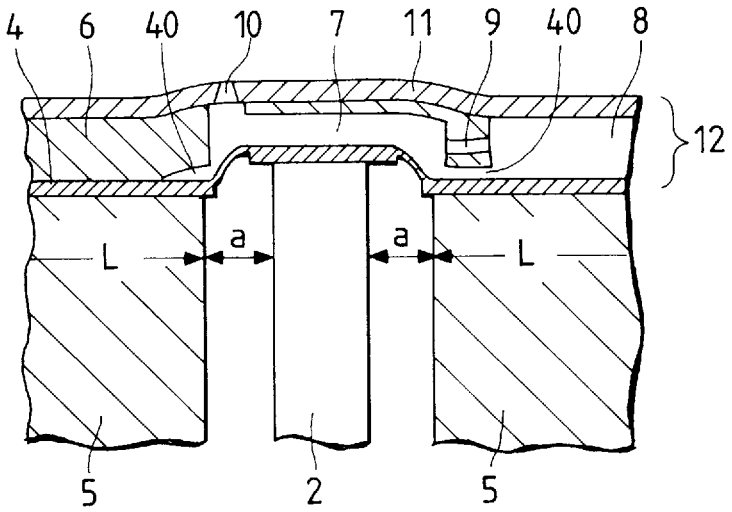
FIG. 6(*a*) to (*c*) are diagrams showing how flow path units are deformed at the time of expelling an ink droplet in conventional ink jet recording heads, respectively.
Figure 6B:
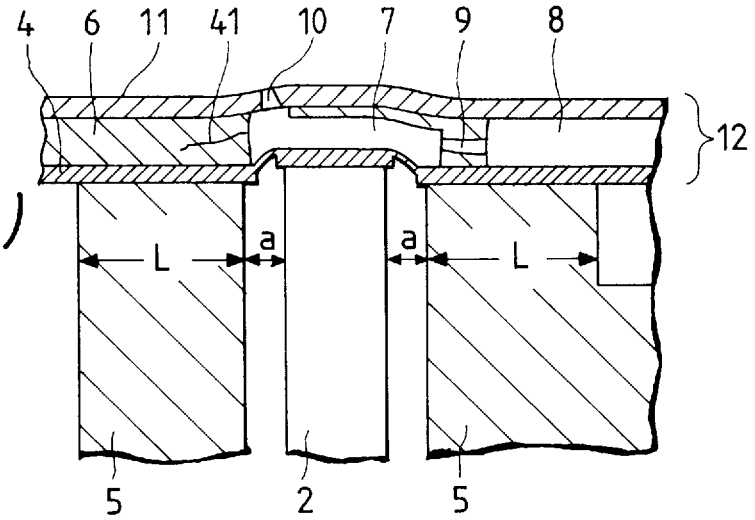
Figure 6C:
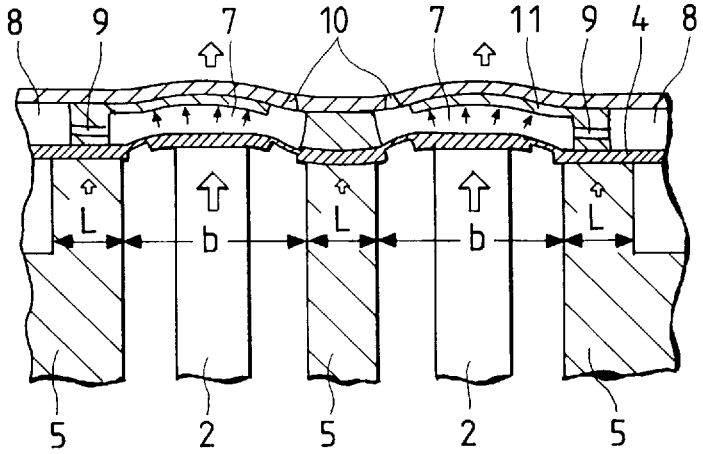

On the other hand, if the distance a from the inner surface of the head frame 5 to the side surface of the piezoelectric vibration element 2 is small, the spacer 6 is separated from the resilient plate 4 in a manner similar to the aforementioned case, or a crack 41 is developed in the spacer 6 if the spacer 6 is made of a material such as photosensitive resin or the like whose brittleness is increased at low temperatures when exposed to temperatures greatly different from a bonding temperature since shearing stresses and shearing strains applied to the flow path unit 12 portion over the distance a are increased (FIG. 6(*b*)) although the amount of deformation due to the difference in the thermal expansion coefficient remains unchanged.

To investigate these conditions, a total of 50 ink jet recording heads were made, each ink jet recording head having. the bonding width L between the head frame 5 and the flow path unit 12 and the distance a between the bonding end and the side surface of a piezoelectric vibration element 2 closest to the head frame 5 set to various values. Such 50 ink jet recording heads were placed at −20° C., which is a critical operating temperature, by reducing the temperature from a bonding temperature of 50° C. to investigate the incidence of separations and cracks at the interface within the flow path unit 12. The result of the investigation is shown in Table 1.

Table 1

As a result, it is verified that if L/a is set to 5 or less, cracks in the spacer 6 and the separation within the flow path unit can be prevented.

On the other hand, if the bonding width L is decreased to decrease the value L/b (FIG. 6(*c*)), then the rigidity at the bonding surface between the head frame 5 and the flow path unit 12 is reduced, which in turn reduces the function of preventing the deformation of the flow path unit 12 at the ink expelling time which is essentially required for the head frame 5, thus causing crosstalks, which is a phenomenon that an ink droplet is expelled from a nozzle opening 2 to which a print signal is not applied, or causing the so-called "misfire", which is a phenomenon that an ink droplet is not expelled even if a print signal is applied.

To investigate these conditions, a total of 50 ink jet recording heads were similarly made, each ink jet recording head having the distance b between the bonding ends of the head frame 5 interposing the piezoelectric vibration element 2 therebetween set to 1.1 mm, whereas the bonding width L between the head frame 5 and the flow path unit 12 set to various values. The incidence of defective ink droplet expelling operations was checked. The result is shown in Table 2.

Table 2

It is verified from Table 2 that the head frame 5 is given such a rigidity as to receive the deformation of the flow path unit 12 at the time of expelling an ink droplet without causing defective ink droplet expelling operation if L/b is set to at least 0.5 or more.

From the above, it is concluded that the bonding width L between the head frame 5 and the flow path unit 12, the distance a from the bonding end of the head frame 5 to the piezoelectric vibration element closest to the head frame 5, and the gap b between the bonding ends of the head frame 5 interposing the piezoelectric vibration element are desirably set so that the following relationship is established.

$0.5b \leqq L \leqq 5a$

As a result of this design, the head frame 5 is given such a rigidity as not to cause defective ink droplet expelling operation and as to receive the deformation of the flow path unit 12 at the ink droplet expelling time caused by ambient temperature change. Therefore, printing quality is not impaired, and the occurrence of separations and cracks in the flow path unit to temperature change can be prevented.

In this embodiment, when print signals are applied to all the piezoelectric vibration elements 2, 2, 2 . . . of the nozzle opening arrays to give displacements Na (about 0.5 to 3 μm) to the respective piezoelectric vibration elements 2, the ink in the respective pressure producing chambers 7 is pressurized to about 1 to $3\times10^5$ Pa and ink droplets are expelled from the nozzle openings 10, 10, 10 . . . .

Figure 7:
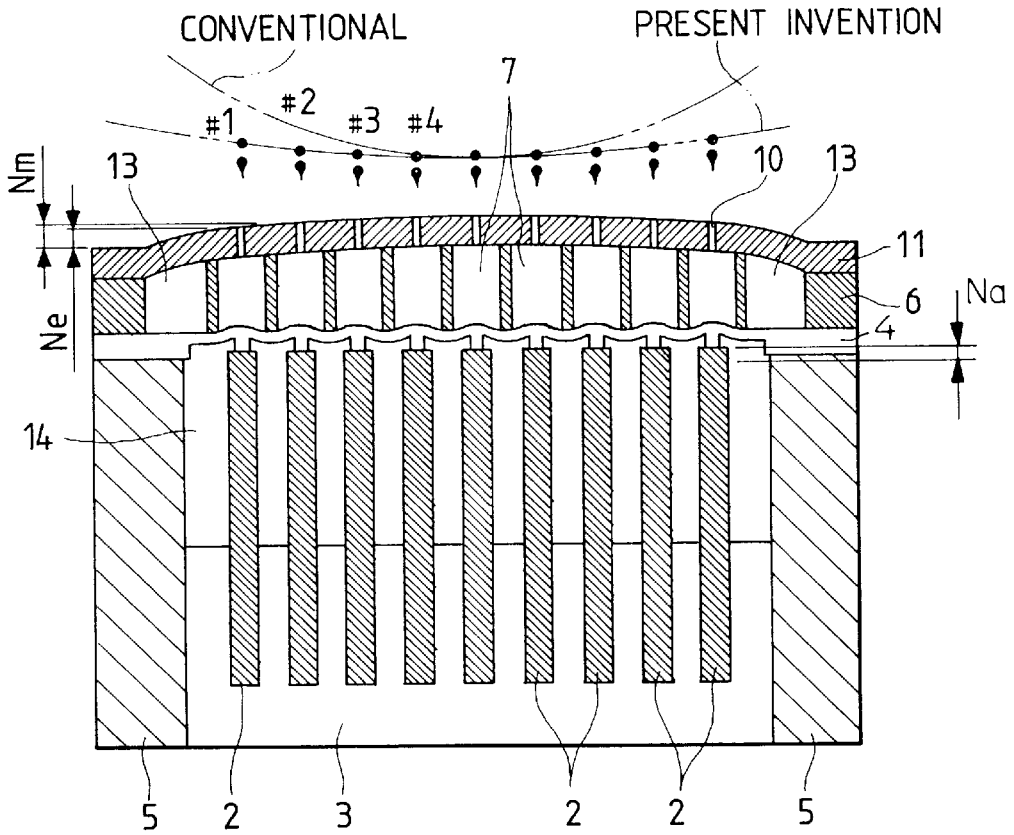
FIG. 7 is a diagram showing how the flow path unit in a direction of a nozzle opening array is deformed at the time of expelling an ink droplet in the invention.

The expanding displacements Na of the piezoelectric vibration elements 2, 2, 2 . . . act as a force to deform the flow path unit 12 as a whole. However, the presence of the hollows 13 close to the bonding region between the flow path unit 12 and the head frame 5 causes the hollows 13 to flex, and this causes a region where the nozzle openings 10, 10, 10 . . . are formed to uniformly flex as a whole as shown in FIG. 7.

EXAMPLE

An ink jet recording head having 16 pressure producing chambers 7 was prepared under the following conditions. The nozzle plate 11 is made of an 80 μm thick stainless steel plate; the spacer 6 is made of an about 200 μm thick photosensitive resin; the resilient plate 4 is made of a 20 μm thick nickel foil; the head frame 5 is made of a liquid crystal polymer; the length of the pressure producing chamber 7 is set to about 1.2 mm; the width thereof, to 200 μm; and the width of the hollow 13 is set to about 300 μm.

When the piezoelectric vibration element 2 is driven so that the amount of displacement thereof Na is equal to about 0.6 μm, a desired ink droplet can be obtained.

Figure 8:
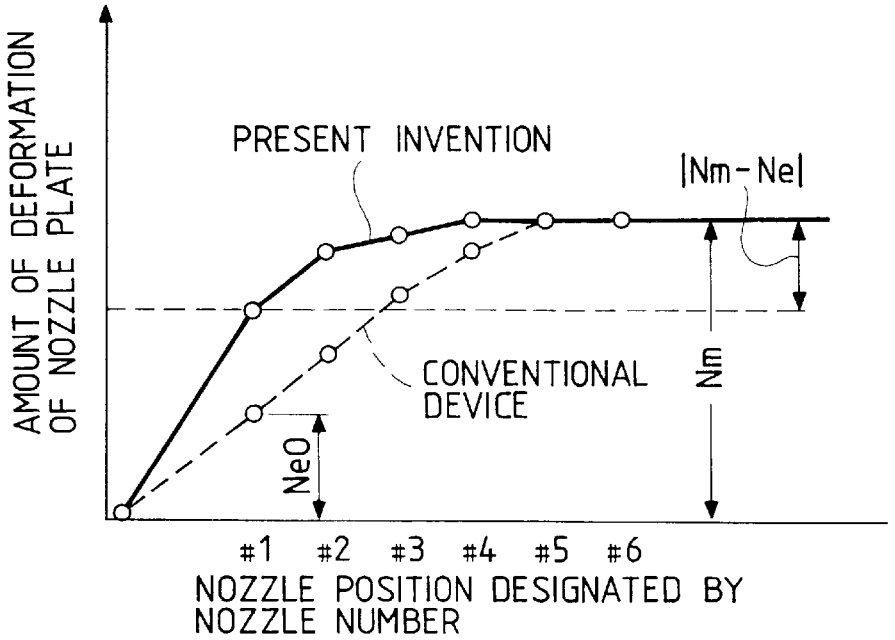
FIG. 8 is a diagram showing the amounts of deformation of nozzle plates of the ink jet recording head of the invention and of the conventional ink jet recording head per nozzle position.

The amount of deformation of the surface of the nozzle plate 11 was measured using a laser doppler displacement gauge while an ink droplet is being expelled. An amount of deformation Nm in the middle portion was equal to about 0.14 μm and an amount of deformation Ne in the nozzle openings 10', 10' on both end portions was equal to about 0.1 μm as indicated by the solid line in FIG. 8. A difference between the ink droplet expelling speed at the nozzle openings in the middle portion and that on both end portions was equal to about 7%.

Further, when a horizontal line is printed on a recording medium, there are differences of about 5 to 10 μm in the line width produced by the ink droplets on the end portion and in the middle portion.

Figure 9:
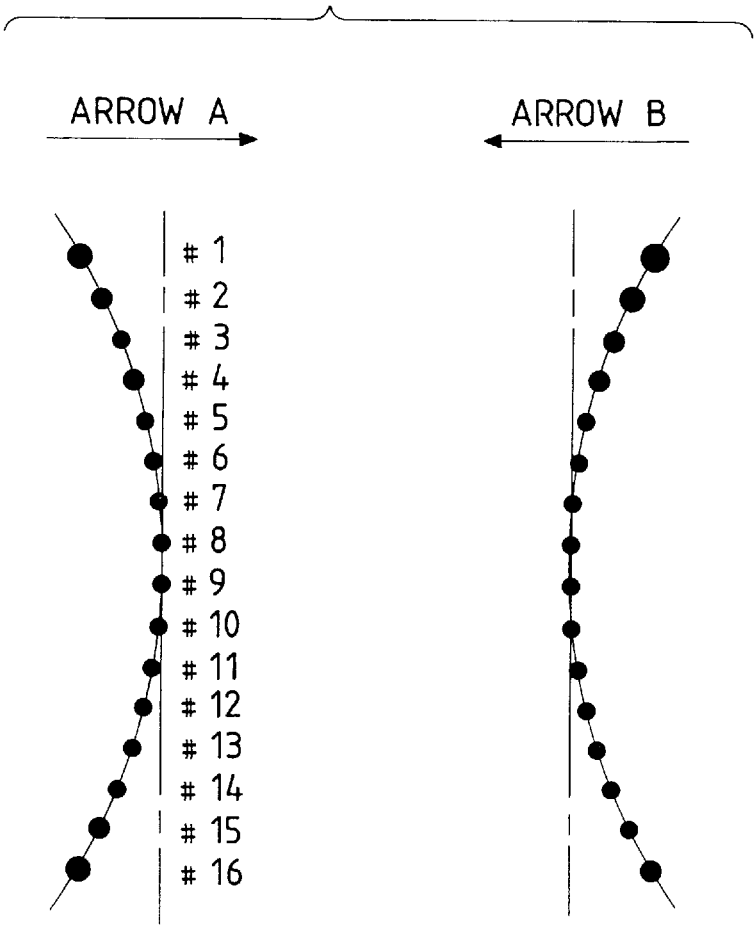
FIG. 9 is a diagram showing the positional displacement of a dot formed on a recording medium caused by the deformation of a nozzle plate in the conventional ink jet recording head.

In contrast thereto, the conventional ink jet recording head having no hollows 13 exhibited an amount of deformation Nm of about 0.1 μm in the middle portion of the nozzle plate and an amount of deformation Ne of about 0.05 μm on both end portions. That is, the difference between these amounts is about twice that of the invention as indicated by a broken line in FIG. 8. A difference between the ink droplet expelling speed in the middle portion and that on both end portions is as large as about 17%. As a result, dots formed by the respective nozzle openings are arranged so as to be curved as shown in FIG. 9 in the conventional example. When a horizontal line is printed on a recording medium, there are differences of about 15 to 30 μm in the line width produced by the ink droplets on the end portion and in the middle portion.

As described above, it is verified that the ink within the pressure producing chambers 7 can be compressed at substantially the same pressure and therefore that the speed of ink droplets expelled from each nozzle opening 10 and the volume of the ink droplet is made consistent in the invention. As a result, the invention can form dots faithfully to the mode of arrangement of the nozzle openings.

By the way, the positional displacement of a dot formed on a recording medium is caused by the difference in the ink droplet expelling speed. Therefore, to obtain an image whose resolution is, e.g., 360 dpi, an amount of positional displacement D of a dot is given as $$D=Vh\times\Delta G\times|1/Vm1-1/Vm2|$$

if it is assumed that the ink droplet expelling operation repeating frequency is set to about 7.2 kHz; the head travelling speed Vh is set to about 0.5 m/s; the upper and lower limits of the ink droplet expelling speed are set to Vm1, Vm2, respectively; and the gap ΔG between the nozzle opening 10 and the recording medium is set to 1.5 mm.

It is desired that the ink droplet expelling speed Vm be set to about 5 to 10 m/s to ensure stable expelling operation.

Therefore, when the lower limit of the ink droplet expelling speed Vm1 is set to 5 m/s, the upper limit of the ink droplet expelling speed becomes about 6.2 m/s.

If the ink droplet expelling speed Vm1 is set to 7 m/s, then the ink droplet expelling speed Vm2 becomes about 9.6 m/s. Therefore, the ink droplet expelling speed fluctuating rate must be confined within about 25 to 35% or less.

However, since variations in the ink droplet expelling direction, in the ink droplet shaping accuracy, further variations in the recording medium forwarding speed and direction, and the like are present in reality, the ink droplet expelling speed fluctuation rate must be confined within about 15% or less, or more preferably within 10% or less in consideration of these variation-causing factors.

In consideration of the above conditions, to reduce the positional displacements of the ink droplets formed by the pressure producing chambers 7', 7' on both end portions of the nozzle opening arrays and the pressure producing chambers 7, 7, . . . in the middle portion, the difference in the amount of deformation |Nm−Ne| between the amount of deformation Ne of the nozzle plate 11 on the end portions of the nozzle opening array and the amount of deformation Nm close to the middle portion of the nozzle opening arrays Nm must be confined within a small value.

That is, since an ink droplet is expelled by the amount of displacement Na of the piezoelectric vibration element 2, the amount of deformation Nm must be smaller than Na since the pressure of ink is not increased and since the ink droplet expelling speed becomes extremely slow even though the ink droplet could barely be expelled, thus making the ink droplet expelling operation unstable.

Further, the difference in the magnitude of the displacement Na of the piezoelectric vibration element 2 leads to a difference in the expelling speed and volume of an ink droplet. That is, the larger the displacement Na of the piezoelectric vibration element 2 is, the higher and larger the expelling speed and volume of the ink droplet becomes.

Still further, as described above, it is the amount of deformation of the nozzle plate 11 that causes the difference in the speed and volume of an ink droplet expelled.

In consideration of the above, various investigations have also been made. From the results of the investigations, it is verified that it is extremely effective to control the difference in the amount of deformation |Nm−Ne| between the amount of deformation Ne of the nozzle plate 11 on the end portions and the amount of deformation Nm close to the middle portion of the nozzle opening arrays to 10% of the displacement Na of the piezoelectric vibration element 2 in order to suppress variations in the expelling speed and volume of the ink droplet.

As a means for achieving this, it was effective to form the hollows 13 close to the fixed points of the flow path unit 12 with respect to the head frame 5 as described above so that regions more susceptible to deformation than the fixed points could be formed between the fixed points and the nozzle opening array region.

Figure 10A:
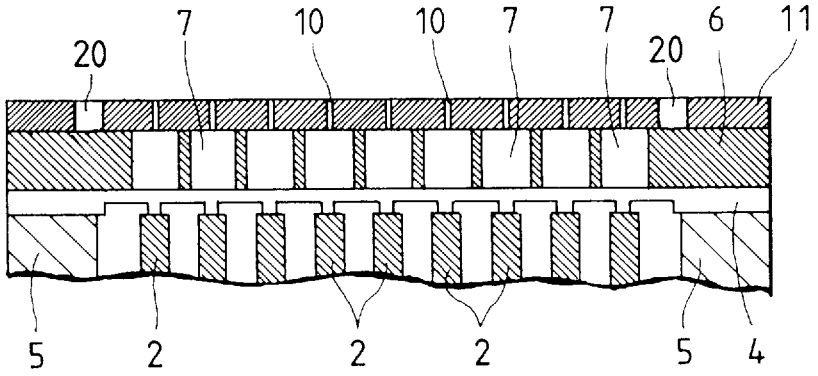
FIG. 10(*a*) to (*c*) diagrams showing other embodiments of the invention, respectively.
Figure 10B:
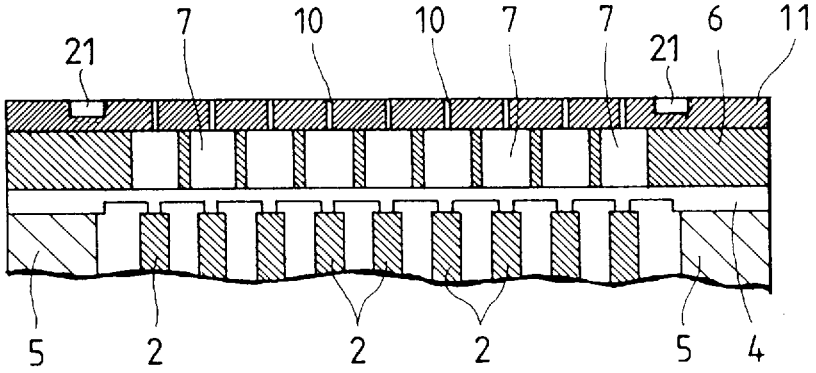
Figure 10C:
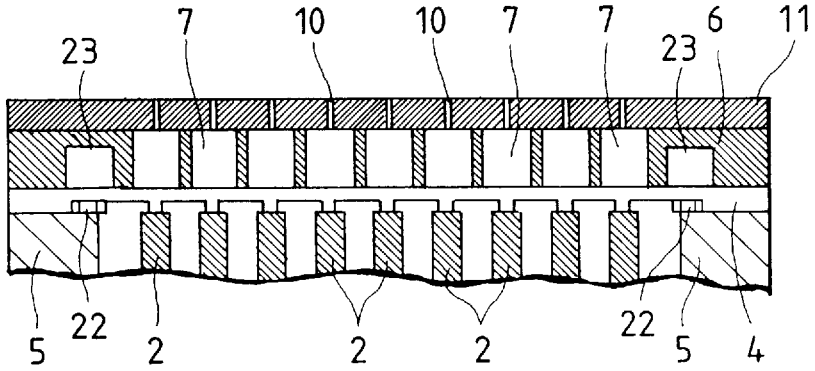

FIGS. 10(*a*) to (*c*) show other embodiments of the invention. FIG. 10(*a*) is an ink jet recording head characterized as having slits 20, 20 close to fixed regions of the nozzle plate 11 with respect to the head frame 5 by press working, etching, or a like method, the slits serving as through holes. FIG. 10(*b*) is an ink jet recording head characterized as having recesses 21 that form thin wall portions.

The slits 20 and the recesses 21 are arranged at the boundary of the flow path unit 12 with respect to the head frame 5 where stresses concentrate most as the piezoelectric vibration elements 2, 2, 2 expand; a part thereof are arranged at the piezoelectric vibration element accommodating chamber 14; and a part thereof are arranged so as to confront the head frame 15. The width of the slit or recess ranges from about 50 to 300 μm.

The presence of the slits 20 and the recesses 21 cause these portions to be deformed intensively by the expansion of the piezoelectric vibration elements 2. Therefore, the nozzle opening forming region that is inward with resect to these portions come to be flexed uniformly, thus making the difference in the amount of deformation on the end portion and in the middle portion |Nm−Ne| smaller.

Further, an embodiment shown in FIG. 10(*c*) is characterized as including thin wall portions 22, each having such a width as to stretching over the piezoelectric vibration element accommodating chamber 14 and the head frame 5 at the boundary of the resilient plate 4 with respect to the head frame 5. In this embodiment also, the thin wall portions 22 are intensively deformed, which in turn allows the amount of deformation of the nozzle opening array region to be made similarly uniform. While the thin wall portions 22 are arranged on a side confronting the head frame 5, it is apparent that similar effects can be obtained by arranging the thin wall portions 22 in the spacer 6.

Further, while the case where the hollows 13, the slits 20, the recesses 21, and the thin wall portions 22 are formed singly in the aforementioned embodiments, it is apparent that a combination of hollows with slits, the recesses, or the thin wall portions may provide better effects. The thin wall portions in the spacer 6 may be formed or created, for example, by the recesses 23 shown in FIG. 10(*c*).

Figure 11:
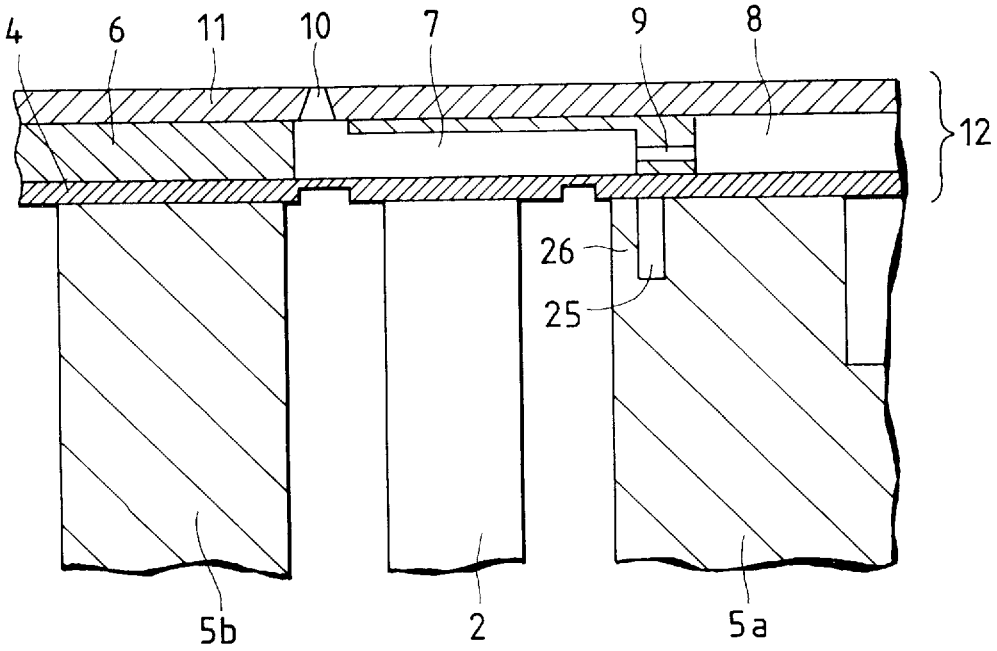
FIG. 11 is a diagram showing another structure of a bonding region between the flow path unit and the head frame.

FIG. 11 shows still another embodiment of the invention. This embodiment is characterized as forming a groove 25 extending in the pressure producing chamber arrangement direction in a head frame 5*a* on the ink supply inlet 9 side so that a region 26 is formed in a region of the head frame 5 which is susceptible to interfacial separation and the like on the piezoelectric vibration element accommodating chamber 14 side, the region 26 being such as to selectively absorb distortion caused by the difference in the thermal expansion coefficient while keeping the bonding width L between the flow path unit 12 and the head frame 5, the distance a between the confronting surface of the piezoelectric vibration element 2 and that of the head frame 5, and the width b of the piezoelectric vibration element accommodating chamber 14 interposing the piezoelectric vibration element 2 set so that such a relationship as $0.5b \leqq L \leqq 5a$ can be established.

According to this embodiment, the head frame 5 can be deformed to such a degree as to suppress the deformation of the flow path unit 12 due to temperature change as much as possible by the region 26 defined by the groove 25, whereas the head frame 5 exhibits sufficient rigidity as a whole. Therefore, the deformation of the flow path unit can be prevented to such a degree as to maintain satisfactory ink droplet expelling performance while preventing the flow path unit 12 from being damaged due to ambient temperature change.

Figure 12:
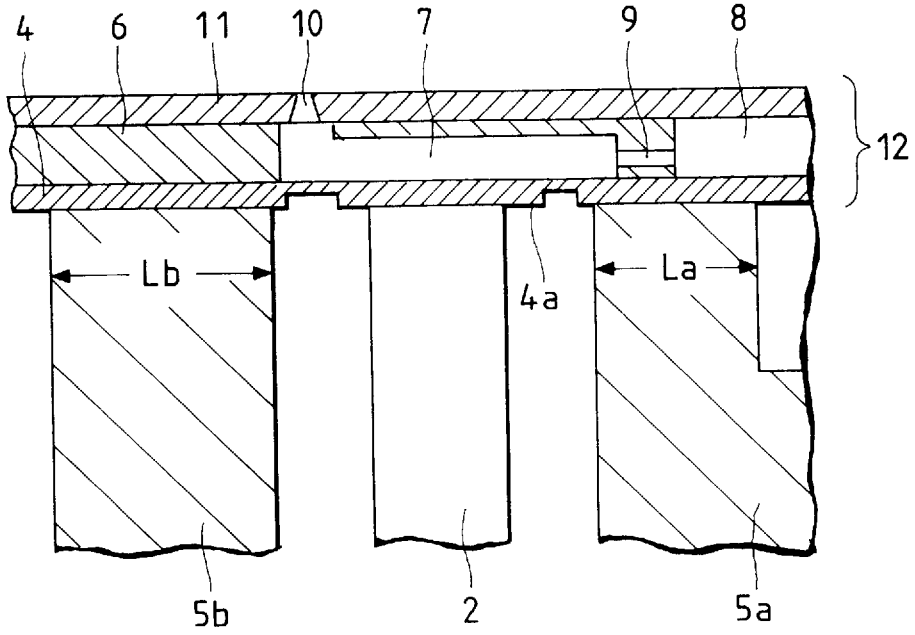
FIG. 12 is a diagram showing another embodiment of the bonding region between the flow path unit and the head frame.

FIG. 12 shows still another embodiment of the invention. This embodiment is characterized as making the boding width Lb of the head frame 5*b* on the nozzle opening 10 side with respect to the flow path unit 12 larger than the width La of the head frame 5*a* on the ink supply inlet 9 side while keeping the bonding width L of the flow path unit 12 with respect to the head frame 5, the distance a between the confronting surfaces of the piezoelectric vibration element 2 and the head frame 5, and the width b of the piezoelectric vibration element accommodating chamber 14 in the direction of interposing the piezoelectric vibration element 2 set so that such a relationship as $0.5b \leqq L \leqq 5a$ can be established.

According to this embodiment, the rigidity of the head frame 5*a* on the ink supply inlet 9 side is relatively decreased, which in turn suppresses development of cracks in the spacer 6 and separation of the spacer 6 from the resilient plate 4 due to ambient temperature change more effectively.

Further, since the rigidity of the head frame 5*b* on the nozzle opening 10 side largely affects control over the deformation of the flow path unit 12 at the time of expelling an ink droplet, it is more effective to relatively increase the bonding width Lb of the head frame 5*b* on the nozzle opening side in order to improve printing quality As described in the foregoing, the invention is characterized as setting the bonding length L of the head frame with respect to the flow path unit in the direction orthogonal to the arrays of pressure producing chambers to $0.5b \leqq L \leqq 5a$ if it is assumed that the distance from the bonding end to the end of the piezoelectric vibration element 2 closest to the head frame 5 is a and that the gap between the bonding ends of the head frame interposing the piezoelectric vibration element 2 is b. Therefore, the function of absorbing internal stresses in the flow path unit caused by ambient temperature change can be given to the head frame while keeping such a rigidity as to suppress the deformation of the flow path unit necessary in maintaining printing quality, which in turn contributes to preventing the spacer from cracking or the spacer from being separated from the resilient plate while maintaining printing quality.

TABLE 1

| BONDED WIDTH (L) BETWEEN HEAD FRAME AND FLOW PATH UNIT (mm) | DISTANCE (a) BETWEEN CONFRONDING SURFACE OF PIEZOELECTRIC VIBRATION ELEMENT AND THAT OF HEAD FRAME (mm) | L/a | RATIO OF INCIDENCE OF SEPARATIONS AND CRACKS (FIFTY HEAD TESTING) |
|---|---|---|---|
| 1.2 | 0.3 | 4 | 0/50 |
| 1.5 | 0.3 | 5 | 0/50 |
| 1.8 | 0.3 | 6 | 2/50 |
| 3.0 | 0.3 | 10 | 25/50 |
| 1.2 | 0.24 | 5 | 0/50 |
| 1.2 | 0.15 | 6 | 7/50 |
| 1.2 | 0.15 | 8 | 27/50 |

TABLE 2

| BONDED WIDTH (L) BETWEEN HEAD FRAME AND FLOW PATH UNIT (mm) | DISTANCE(b) BETWEEN BONDING ENDS OF VIBRATION ELEMENT (mm) | L/b | MISSFIRE OCCURRENCE RATE (%) $\left(\frac{\text{NUMBER OF MISS FIRE NOZZLES}}{\text{NUMBER OF INVESTIGATING NOZZLES}} \times 100\right)$ |
|---|---|---|---|
| 0.33 | 1.1 | 0.3 | 40~50 |
| 0.45 | 1.1 | 0.4 | 5~10 |
| 0.55 | 1.1 | 0.5 | 0~1 |
| 1.1 | 1.1 | 1 | 0 |

What is claimed is:

1. An ink jet recording head comprising:

a flow path unit formed of a spacer, a nozzle plate, and a resilient plate, the spacer having a plurality of pressure producing chambers on a single plane in a form of an array, the nozzle plate having nozzles communicating with the pressure producing chambers and being laminated on one surface of the spacer, the resilient plate being laminated on another surface of the spacer;

piezoelectric vibration elements for selectively changing a capacity of the pressure producing chambers while abutted against the resilient plate; and a head frame having cavities in which the piezoelectric vibration elements are received, said head frame including a plurality of walls which are bonded to said resilient plate, said walls at least partially defining said cavities;

wherein a bonding width L of the walls of the head frame in a direction orthogonal to the array of the pressure producing chambers is set to $0.5b \leqq L \leqq 5a$ where a is a distance from a side face of each of said walls to an opposing side face-of said piezoelectric vibration elements; and b is a width of said cavities as defined by opposing faces of said walls.

2. An ink jet recording head according to claim 1, wherein at least one of said walls has a groove formed therein which is parallel with the array of the pressure producing chambers.

3. An ink jet recording head according to claim 1 wherein a bonding width Lb of one of said walls on a nozzle opening side with respect to the flow path unit is larger than a bonding width La of another of said walls of the head frame on an ink supply inlet side with respect to the flow path unit, the ink supply inlet side communicating with one of the pressure producing chambers.

4. An ink jet recording head comprising:

a flow path unit being formed of a spacer, a nozzle plate, and a resilient plate, the spacer having a plurality of pressure producing chambers disposed in a single plane and arranged in an array, the nozzle plate having a nozzle opening forming region and nozzles in said region, the nozzles being in fluid communication with the pressure producing chambers, the nozzle plate being laminated on one surface of the spacer, the resilient plate being laminated on another surface of the spacer;

piezoelectric vibration elements for selectively changing a capacity of the pressure producing chambers, said piezoelectric vibration elements being abutted against the resilient plate; and a head frame having cavities in which the piezoelectric vibration elements are received, said head frame being bonded to said flow path unit at fixed bonding regions of said head frame and said flow path unit;

wherein a rigidity of the flow path unit in said fixed bonding regions at opposite ends of said flow path unit in a direction of said array is less rigid than the rigidity of the flow path unit in said nozzle opening forming region.

5. An ink jet recording head according to claim 4, comprising slits or recesses formed in portions of the nozzle plate in said fixed bonding regions at the opposite ends of said flow path unit in the direction of said array for reducing the rigidity of the flow path unit.

6. An ink jet recording head according to claim 4, comprising thin wall portions formed in portions of the resilient plate in said fixed bonding regions at the opposite ends of said flow path unit in the direction of said array for reducing the rigidity of the flow path unit.

7. An ink jet recording head according to claim 4, comprising thin wall portions formed in portions of the spacer in said fixed bonding regions at the opposite ends of said flow path unit in the direction of said array for reducing the rigidity of the flow path unit.

8. An ink jet recording head comprising:

a flow path unit being formed of a spacer, a nozzle plate, and a resilient plate, the spacer having a plurality of pressure producing chambers on a single plane in a form of an array, the nozzle plate having nozzles communicating with the pressure producing chambers and being laminated on one surface of the spacer, the resilient plate being laminated on another surface of the spacer;

piezoelectric vibration elements for selectively changing a capacity of the pressure producing chambers while abutted against the resilient plate; and a head frame having cavities in which the piezoelectric vibration elements are received, said head frame being bonded to said flow path unit;

wherein an amount of deformation Ne of the nozzle plate in a region confronting a pressure producing chamber on an outermost end of the array, an amount of deformation Nm of the nozzle plate in a region confronting a pressure producing chamber in the middle of the nozzle opening array, and an amount of displacement Na of the piezoelectric vibration elements are set to $|Nm-Ne| \leqq 0.1 \times Na$.

* * * * *